US005103927A

United States Patent [19]

Heavener

[11] Patent Number: 5,103,927

[45] Date of Patent: Apr. 14, 1992

[54] VARIABLE PATTERN, COLLAPSIBLE, DIRECTIONAL TRANSDUCER

[76] Inventor: James D. Heavener, 7936 Camino Cir., Miami, Fla. 33143

[21] Appl. No.: 563,355

[22] Filed: Aug. 7, 1990

[51] Int. Cl.[5] ..... G10K 13/00; H04R 25/00

[52] U.S. Cl. ..... 181/158; 181/164; 181/173; 381/153; 381/169; 381/205

[58] Field of Search ..... 181/158, 157, 160, 164, 181/167, 170, 173, 174, 132, 137; 381/205, 168, 169, 155, 160, 156, 153

[56] References Cited

U.S. PATENT DOCUMENTS 1,986,609 1/1935 Snoek ..... 381/160
3,032,138 5/1962 Haerther, Jr. ..... 181/164
4,314,098 2/1982 Maerfeld ..... 381/160 X
4,836,326 6/1989 Wehner ..... 381/169 X

*Primary Examiner*—Russell E. Adams
*Assistant Examiner*—Jae Noh
*Attorney, Agent, or Firm*—Robert Downey

[57] ABSTRACT

This is a highly directional floor microphone. A pair of hinged panels rest upon the floor. A compliance may be used to acoustically seal the panels to the floor. At the apex of the floor and hinge is a transducer. The hinged panels are trapezoidal in shape and the hinge is acoustically opaque. The floor increases the directivity 6 dB. The panels increase the directivity by 12 dB. Tapering the panels in a trapezoidal shape increases the directivity by 2 dB. The total increase in directivity is 20 dB, allowing a working distance of ten times that of an omni-directional microphone. The folding nature allows easy storage and carriage.

7 Claims, 1 Drawing Sheet

VARIABLE PATTERN, COLLAPSIBLE, DIRECTIONAL TRANSDUCER

BACKGROUND OF THE INVENTION

1. The Field of the Invention

This invention relates in general to transducers, and in particular to directional boundary-type microphones. In this particular field of directional boundary-type microphones, the emphasis is upon extending the art, to create a device combining the pick-up distance of the fixed-boundary type with an adjustable pick-up pattern and having ease of carriage and storage.

2. Background Information

In live theatre, a problem exists in being able to clearly hear and understand the actors' voices (used in this document, the word actor also applies to actresses, as well as musicians and other desired sound sources). In addition to all the other items needed for good sound reinforcement in a theatre, it is preferred to have microphones that can provide the following qualities:

Easily adjustable horizontal angle of pick-up with little change in level, to allow for the variations in microphone placement, scenery and unwanted noise sources. Horizontal adjustment extends from narrow to very wide, so that actors are not limited in their movement about the stage.

Portability for ease of storage and shipping.

Narrow vertical angle of pick-up, rejecting sound from any loudspeakers located over the stage, reducing possible feedback. With some means of adjustment allowing for pickup of actors physically close to the microphone.

High intelligibility. The microphone should pick up direct sounds of the actors' voices, and reject voice reflections, reducing comb-filtering. Comb-filter refers to the appearance of a frequency response graph, produced when signals of the same frequency but differing path lengths combine.

Not just high directivity, rather, higher sensitivity within acceptance pattern; very low sensitivity in rejection pattern. Sound pick-up from wanted directions should be consistent and smooth with very little change in level versus angle. Transition from the accepting side to the rejecting side should be abrupt with very little pick-up over the entire rejecting side. This implies use of boundary pattern microphones which have a polar response essentially even from boundary to boundary, with a sharp reduction in response behind the boundary. This is in contrast to limaçon pattern (cardioid, figure-of-8, hyper-cardioid) microphones, which have an acceptance pattern that gradually changes to a very small rejection pattern. (A limaçon is a unicursal curve of the fourth order, investigated and named by the mathematician Blaise Pascal.) This gradual change means limaçon pattern microphones do not perform as well as boundary-type microphones. The ratio of on-axis energy response to random sounds of an ideal limaçon pattern microphone is, at best, 6 dB; while that of an ideal triple-boundary microphone covering a 90-degree horizontal and 60-degree vertical pattern exceeds 18 dB. The combination boundary, hyper-cardioid (CROWN PCC) is, at best, 12 dB. Limaçon pattern microphones don't cover all of their rated angle of pick-up at full sensitivity as do boundary microphones.

A high signal-to-noise ratio, necessary because actors may be at a distance from the microphone. High directivity increases the signal-to-noise ratio by giving more desired signal to the transducer.

Long-distance pick-up. The sound reinforcement system should have good gain-before-feedback, meaning high amplification before oscillation occurs. This is necessary in order to pick-up an actor's voice at a distance. One of the sound system's dependent variables is a microphone having good rejection of sound coming from the loudspeaker as well as surfaces reflecting sound from the loudspeaker, while having good acceptance of sound coming from the actor.

Smooth frequency response. The amplitude response relative to frequency should exhibit low variation over its rated frequency spectrum. To accomplish this it is necessary to reduce comb-filtering.

3. Description of Related Art

Wireless microphones are used in theatres at considerable additional expense and with less reliability due to their dependence on batteries and need for clear-channel radio frequencies, though they do provide high gain before feedback.

Another microphone used in theatres is the "shotgun" type, with a very narrow pick-up pattern (like a spotlight), requiring many units and/or an operator.

4. Prior Art

One of the best practical devices of Prior Art is the "PCC floor-mounted cardioid boundary microphone by CROWN INTERNATIONAL", which has half the pick-up distance of the invention which is the subject of this application.

Other boundary microphones. See SOUND SYSTEM ENGINEERING (SSE), by Don and Carolyn Davis, ISBN O-672-21857-7 pages 296 through 303 and 625 through 629. This publication shows many designs of multi-boundary microphones used with varying degrees of success (though not practical to manufacture) for live theatre and music, including:

Fixed-panel, floor-mounted, multi-boundary microphones (shown on page 626, FIG. VIII-4 of SSE) perform as well as this invention, but are not adjustable, nor easily carried, shipped or stored due to their bulk and/or delicate construction.

The adjustable-angle, boundary microphones (shown on pages 302, 303 and page 627 FIG. VIII-6 of SsE) in comparison to the said fixed-panel types, have less directivity due to having only two boundaries per transducer. One angle of coverage is not adjustable, and at 180 degrees is too large, giving less directivity. If the floor is used as a third boundary, the lack of a seal to the floor compromises the directivity enhancement and the location of the transducer incurs comb-filtering penalties. The angle is adjustable in only one plane, with no means to fix the adjustment.

Whatever the precise merits, features and advantages of the above cited references, none of them achieves or fulfills all of the below-stated objectives. It is clear that to advance the art, it is necessary that a combination of the fixed-panel and adjustable-panel boundary microphones be implemented. This was not possible with existing designs due, to lack of a method to both hinge the panels for adjustability and collapsibility, and simultaneously seal the third side (floor) to the two hinged sides.

OBJECT OF THE INVENTION

The principle object of this invention is to combine the long distance pick-up of the fixed-boundary microphone with the adjustable and collapsible features of the variable-boundary microphone. Another object is to provide a more directional vertical pick-up pattern that may be easily changed to maintain the directivity factor for extremely wide or narrow horizontal angles. The final object is to provide portability, collapsibility and ease of storage.

This will produce a microphone primarily for, but not limited to, stage floor use, which will provide, among others, the following characteristics: long distance pick-up; an easily adjustable horizontal pick-up pattern which may be adjusted from a very wide to a narrow angle; sensitivity that remains high and practically constant over the pick-up area; sensitivity that remains very low and practically constant over a large rejection area; frequency response that remains smooth over the pick-up area; freedom from comb-filtering in the desired frequency spectrum; portability and collapsibility.

Said objectives can be accomplished by providing adjustable, hinged and tapered panels made of a material rigid and heavy enough to be opaque to sound in the frequency spectrum of interest; with a transducer, located very close to the inner apex of the floor, the edges and the hinge, of the panels. The edges rest on a deformable base, causing acoustic sealing of the panels to the flat surface or floor.

In combination, the surfaces formed by the base, floor and panels increase the directivity, giving twice the pick-up distance of other practical stage microphones. Directivity also depends on the bond formed between the panels and the base. The temporary nature of the bond allows this invention's pick-up pattern to be varied by widening or narrowing the angle between the hinged panels.

The hinge allows this invention to be easily folded for storage or shipment.

The above features are important for resident or traveling theatre groups, and school auditoriums. If molded of one piece of polypropylene, this invention is inexpensive to manufacture in comparison with Prior Art.

SUMMARY OF THE INVENTION

In fulfillment and implementation of the previously recited objects, a primary feature of the invention resides in the provision of a unique arrangement of thin, flexible material that can bend horizontally in a hinge-like fashion, while held rigid in the vertical plane; supported by and part of, or attached thereto, rigid panels. Included in this arrangement is the sealing base, deformed by the weight of the panels or added weight, and the thin edge of the flexible material or angled edge of the panels, which seals the accepting side of the panels from the rejecting side of the panels, thus combining the advantages of the fixed-panel and the adjustable-panel boundary-type microphones. As will be explained hereinafter, this enables one to easily adjust and use the horizontal pick-up pattern from a very wide to a narrow angle, and to easily alter the vertical pick-up pattern to maintain the directivity factor for differing horizontal angles, while achieving long-distance pick-up. The invention maintains a sensitivity that remains high and practically constant over the pick-up area, while maintaining a sensitivity that remains very low and practically constant over the large rejection area. This invention has a frequency response that remains smooth over the pick-up area with freedom from comb-filtering in the desired frequency spectrum. This invention easily collapses to store or carry.

These features of the invention are important for use on stage floors or other flat surfaces where it is important to be able to pick-up distant sound with a minimum loss of intelligibility and fidelity.

The novel design of this device allows it to provide a pick-up pattern that is easy to set up, adjust and predict (the response pattern is easy to visualize by simply sighting along the boundaries, a plane extending along each panel from the hinge encompasses the area of pick-up) with a long distance pick-up (twice the distance of other practical wide-angle microphones) and ease of storage.

THEORY OF OPERATION

Combining the long distance pick-up of the fixed boundary microphones with the adjustable features of the variable pattern boundary microphones is accomplished in this invention by means of a temporary seal between two movable hinged panels and a base. The seal is established by using a seamless hinge that is the same surface as the edge contacting the compliant base. This solves the problem of sound leaking past the boundary in the vicinity of the active transducer. The panels' weight against the base forms a seal. This temporary bond allows easy adjustment of the movable panels and allows the panels to be inverted, changing the vertical angle of acceptance.

DETAILED DESCRIPTION

Figure 1:
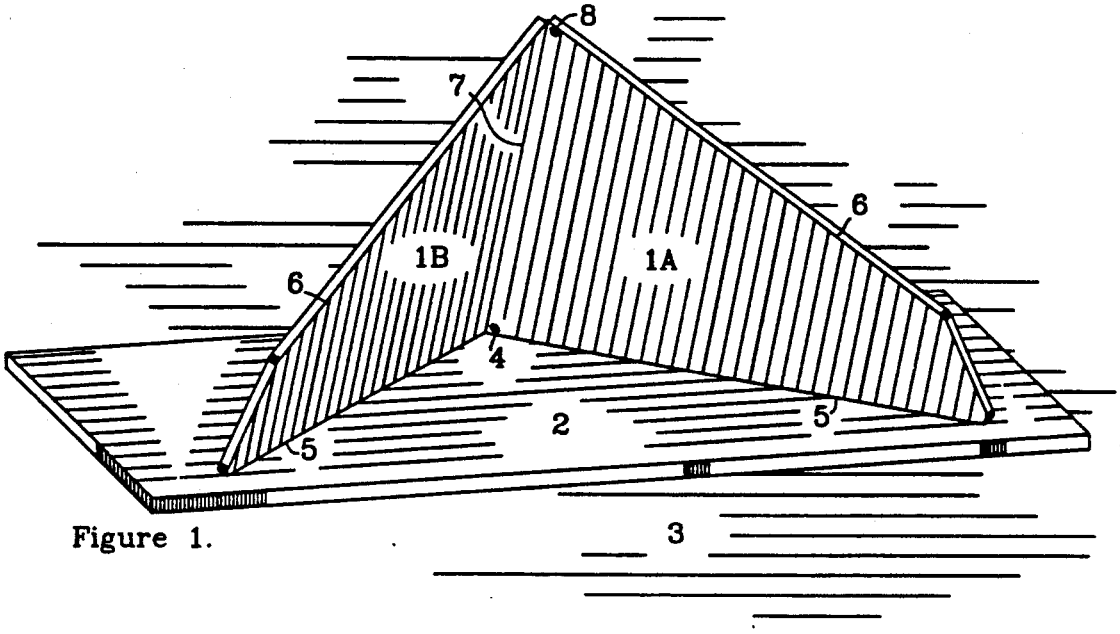
FIG. 1. A front perspective view.

One embodiment of the "variable pattern, collapsible, directional microphone" is seen in FIG. 1. One-piece hinged, moveable panels 1A & 1B that are made of a material thick and heavy enough to be opaque to sound in the frequency spectrum of interest, with a seamless hinge to allow for adjustment.

FIG. 1. A sound collector/director consisting of three planes in the form of a trihedral pyramid with one side open to sound, a transducer mounted close to or at the apex of the three planes, one of the planes a compliant base 2, and two of the planes 1A & 1B joined to each other with a hinge 7 in a manner that permits an acoustic seal between the panels 1A & 1B and base 2 and allows an adjustment of the angles of the sound field.

Figure 5:
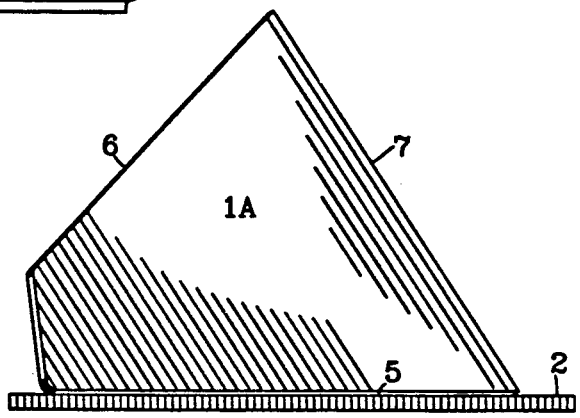
FIG. 5. A side view of a panel, the invention set-up for use, resting on base.

FIG. 5. the sound enters from the left.

One embodiment of the "variable pattern, collapsible, directional microphone" is seen in FIG. 1. One-piece hinged, moveable panels 1A & 1B that are made of a material thick and heavy enough to be opaque to sound in the frequency spectrum of interest, with a seamless hinge to allow for adjustment.

Panels 1A & 1B are constructed of stress-relieved polypropylene, with tapered edges 5 & 6, and a groove, of a depth that leaves a thin section of material, forming the hinge 7. Polypropylene, being strong and flexible enough in thin sections to bend repeatedly without breaking or tearing, and yet being rigid in thicker sections is a good material for this use. The non-grooved side of this hinge 7 being the same surface as the front-side edge 8 or 6 maintains a continuous seal with the base 2.

The weight of the panels 1A & 1B deforms the base 2 sealing the panels' 1A & 1B edges 5 or 6 to the floor 3, or other surface. A tight seal is necessary to maintain rejection from the rear of the microphone. Increasing the panels' weight or using a more compliant base improves the seal.

The tapered edges 5 & 6 cause the slanting of the erected panels, 1A & 1B narrowing the vertical angle of pick-up and improving the efficiency of pick-up from the desired direction, while decreasing unwanted sounds from above (loudspeakers) and behind (orchestra and/or audience).

Figure 2:
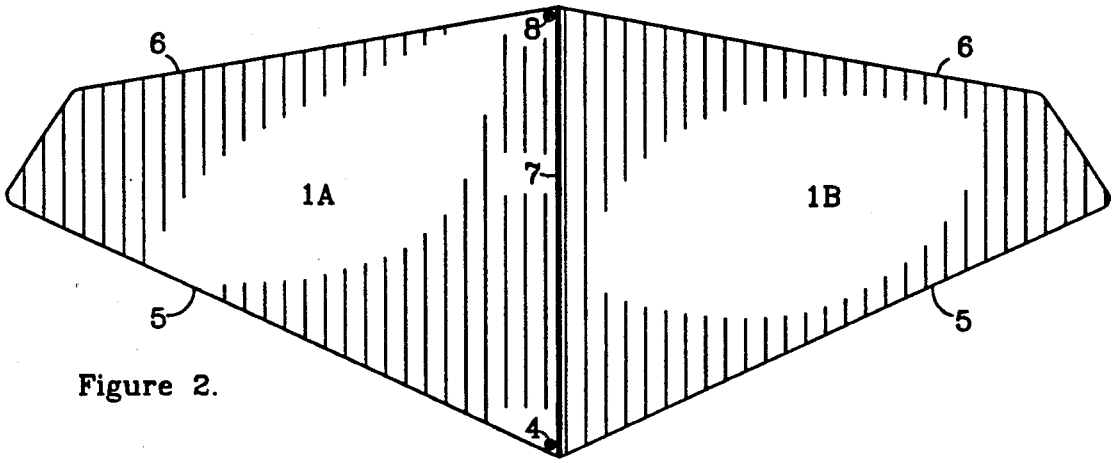
FIG. 2. A plan view of the panels laid open and flat, showing hinge, transducers and edges of tapered panels.

FIG. 2. The panels 1A & 1B, constructed with a different taper on the upper and lower edges 5 & 6, allow a different vertical angle of pick-up when the panels 1A & 1B are inverted, so that edge 6 becomes the bottom and edge 5 becomes the top. This gives the choice of a larger or smaller vertical angle of pick-up and keeps the device from falling over at wide horizontal angles (edge 5 down) or losing rejection (edge 6 down) to overhead sounds when the horizontal angle is narrow.

FIGS. 1 and 2. Two transducers 4 & 8, mounted in the panel 1A, one transducer 4 at edge 5, and one transducer 8 at edge 6, both close to the hinge 7 and connected to a single-pole-double-throw mercury switch (not shown), that being activated by gravity, connects only the lower transducer. This provides an easy change from a large to a small vertical pattern of pick-up, and prevents comb-filtering interference from the inactive top transducer.

The transducer(s) may be mounted either in the panels (as shown), or in the base, or simply left on the surface close to the apex of panels and base.

FIG. 1. It is necessary that the active transducer be placed very close to the apex formed by the base 2 or floor 3 and the panels 1A & 1B to prevent combfiltering. A low frequency shelf (−6 dB) and loss of pattern control occurs below a frequency, dependent on the panels' 1A & 1B size and mass. A lower frequency shelf requires more mass and area, conversely a higher shelving frequency requires less mass and area.

The hinge 7 allows the panels 1A & 1B to be folded for storage and opened to various angles to obtain the desired pick-up pattern.

The panels' tapers work well, giving a vertical angle wide enough to pick up actors who are very close, yet reject sound from an overhead speaker.

As stated: panels are sealed to each other by a hinge and sealed to a compliant base by the deformation of said base due to the weight of the said panels thereupon, with a transducer at the apex of said panels, said hinge and said base.

The seal is established by using a seamless hinge that is the same surface as the edge contacting the compliant base. This solves the problem of sound leaking past the boundary in the vicinity of the active transducer. The panels' weight seals said panels against the base. This temporary bond allows easy adjustment of the movable panels, making it possible to invert the panels, thus allowing the vertical angle of acceptance to be changed.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

OPERATION

Figure 3:
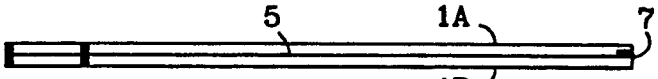
FIG. 3. An end view of the panels folded flat, showing hinge, and edges.
Figure 4:
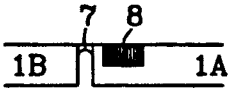
FIG. 4. An enlarged end view of the panels, showing a detail of the hinge, and transducer.

In a theatre this invention may be set up by laying the base on the floor near the front of the stage, partially unfolding the panels from the position shown in FIG. 3, and placing the panels on the base in a manner similar to that shown in FIG. 1. The response pattern is easy to visualize by simply sighting along the plane of the boundaries, (a plane extending along each panel from the lower transducer encompasses the area of pick-up) thus making it easy to set up, adjust and predict the acceptance pattern. The horizontal acceptance angle extends outward from the lower transducer along a plane delineated by each panel, with the vertical acceptance angle extending outward from the lower transducer along a sector delineated by the hinge and floor.

A string may be tied between the inner surfaces of each panel, away from the transducers, preventing the panels from being opened too far, thus preventing possible damage to the hinge.

OTHER METHODS OF OBTAINING THESE FEATURES

Although the drawings show the preferred embodiment, other alternate embodiments are possible. In particular these embodiments envision other methods of simultaneously providing the hinged, continuous seal and close proximity of the transducer thereto.

Many materials and methods were tried, and although others may be used, the following were successful:

Not shown. One transducer mounted in the base 2 and placed very close to the hinge of the panels 1A & 1B. This requires that the base be marked and the operator be careful in placing the panels o the base so that the apex is very close to the transducer. The base is just a compliance and may be rolled up, but the transducer connections are more fragile unless the transducer and connector are mounted to a small plate and placed close to the apex. This arrangement is awkward but functional.

Not shown. The transducer(s) mounted in a panel and placed very close to the hinge of the panels. In this case the hinge and seal are one piece, of flexible material that is attached to the rigid panels by glue, welding or other means. This arrangement is functional.

FIGS. 1 and 2. Two transducers 4 & 8, mounted in the panel 1A, one transducer 4 at edge 5 and one transducer 8 at edge 6, both close to the hinge 7 and wired to separate connectors (not shown). only the transducer 4 nearest the floor 3 is connected, the other transducer 8 being connected when the panels are inverted, in which case the first transducer 4 is disconnected. This is to prevent one transducer from interfering with the other.

The hinge 7 may be molded or cut into the panels 1A & 1B . Molding the panels saves machining labor.

Before polypropylene was used for the panels, other materials (acrylic, steel and aluminum) were tried with hinges of various flexible materials (including polypropylene) attached.

Not shown. One transducer mounted in the panel 1A at the edge and close to the hinge 7, limiting the device to the use of one set of edges 5 or 6. This is easy to build, does not require as much care in placement, but also does not have the advantage of being able to change the vertical pick-up angle.

Not shown. A flexible material sandwiched between rigid panels of a similar shape, the flexible material bending at the hinge, but extending slightly past the edges 5 or 6 and remaining rigid enough to deform the base and form a seal to the base.

What is claimed is:

1. A boundary type directional transducer comprising:

a first panel, a second panel, and a base, said first panel and said second panel each being substantially triangular in shape and including an upper edge, a lower edge, an inner side, and an outer side, said first panel being hingedly attached to said second panel along correspondingly positioned abutting edges by hinging means, thereby forming a continuous hinged seal, said hinging means connecting said panels along said inner sides thereof, such that said panels may be folded between a collapsed position and an operable angled position, said base being formed of a resilient material and being structured and disposed to supportably receive said lower edges of said first panel and said second panel so as to form a continuous seal, at least one transducer mounted near an apex of said hinged seal between said first panel and said second panel, and whereby said first panel and said second panel are substantially vertical relatively to said base, an angled relative to each other, when in said operable position, each that a sound collector is defined therein.

2. A boundary type directional transducer as recited in claim 1 wherein said transducer is a microphone.

3. A boundary type direction transducer as recited in claim 1 wherein said transducer is a loud speaker.

4. A boundary type directional transducer as recited in claim 1 wherein said first panel and said second panel are tapered at said upper edge and said lower edge.

5. A boundary type directional transducer as recited in claim 4 wherein said tapered upper edge is adapted to engage said base and includes a tapered angle being different from a tapered angle of said tapered lowered edge, such that inverting said panels changes a vertical pick up angle.

6. A boundary type directional transducer as recited in claim 5 wherein said hinging means includes a strip of acoustically opaque flexible material attached to said inner side of said abutting edges of said panels, so as to allow for varying angles between said sides.

7. A boundary type directional transducer as recited in claim 1 wherein said panels are formed of a substantially rigid, acoustically opaque material.

* * * * *